US006418913B1

(12) United States Patent
Schmidt et al.

(10) Patent No.: US 6,418,913 B1
(45) Date of Patent: Jul. 16, 2002

(54) ELECTRIC-ACTUATED FUEL INJECTOR HAVING A PASSIVE OR MEMORY CIRCUIT AS A CALIBRATION GROUP IDENTIFIER

(75) Inventors: Robert A. Schmidt, Hoffman Estates; Radek A. Oleksiewicz, Riverwoods; Robert P. Grassi, Bartlett, all of IL (US)

(73) Assignee: International Engine Intellectual Property Company, L.L.C., Warrenville, IL (US)

( * ) Notice: Subject to any disclaimer, the term of this patent is extended or adjusted under 35 U.S.C. 154(b) by 0 days.

(21) Appl. No.: 09/696,361

(22) Filed: Oct. 25, 2000

(51) Int. Cl.[7] ..... F02D 41/20
(52) U.S. Cl. ..... 123/480; 73/119 A; 123/478
(58) Field of Search ..... 123/478, 480, 123/486; 73/119 A

(56) References Cited

U.S. PATENT DOCUMENTS 4,379,332 A 4/1983 Busser et al.
4,402,294 A 9/1983 McHugh et al.
4,972,293 A 11/1990 Verner ..... 123/480 X
5,575,264 A 11/1996 Barron
5,634,448 A 6/1997 Shinogle et al.
5,839,420 A 11/1998 Thomas
6,112,720 A 9/2000 Matta

*Primary Examiner*—Tony M. Argenbright
(74) *Attorney, Agent, or Firm*—Dennis Kelly Sullivan; Jeffrey P. Calfa; Neil T. Powell

(57) ABSTRACT

A fuel injector has a body containing a mechanism that is operable to cause fuel to be injected out of the body and into an engine combustion chamber. An electric actuator operates the mechanism to initiate fuel injection and to terminate fuel injection. The injector has an identity circuit that possesses an identity characteristic identifying a calibration category into which the fuel injector has been previously categorized based on data obtained from actual operation of the fuel injector. In some embodiments the identity circuit is electrically connected in shunt with the electric actuator and imposes no significant effect on the response of the fuel injector to the initiating and terminating electric signals. In others, it is connected between engine ground and one actuator terminal.

23 Claims, 3 Drawing Sheets

ELECTRIC-ACTUATED FUEL INJECTOR HAVING A PASSIVE OR MEMORY CIRCUIT AS A CALIBRATION GROUP IDENTIFIER

FIELD OF THE INVENTION

This invention relates generally to electric-actuated fuel injectors that inject fuel into combustion chambers of internal combustion engines, and in particular to calibration group identifiers for such fuel injectors.

BACKGROUND OF THE INVENTION

An electric-actuated fuel injector for a compression-ignition internal combustion engine may comprise an intensifier piston for creating a high pressure injection of fuel directly into an associated engine cylinder. An intensifier piston comprises a head of given end area exposed to a control fluid, oil for example, in a control chamber, and a plunger, or rod, of smaller end area exposed to liquid fuel in an injection chamber.

The fuel injector may comprise an electric-actuated spool valve for controlling both the introduction of pressurized control fluid into the control chamber and the draining of control fluid from the control chamber. When an electric signal for initiating a fuel injection is applied to an electric actuator of the spool valve, control fluid is introduced under pressure through one portion of the spool valve into the control chamber to downstroke the intensifier piston and cause fuel in the injection chamber to be injected under pressure from a nozzle of the fuel injector into an associated engine cylinder. The intensifier piston is effective to amplify the pressure of the control fluid by a factor equal to the ratio of the head end area to the plunger end area and cause the amplified pressure to be applied to liquid fuel in the injection chamber. As a result, fuel is injected into a combustion chamber at a pressure substantially greater than the pressure of the control fluid. When the electric signal changes to one for terminating the fuel injection, the spool valve operates to terminate the downstroke of the intensifier piston and instead allow control fluid to drain from the control chamber through another portion of the spool valve so that the intensifier piston can upstroke to re-charge the injection chamber with liquid fuel in preparation for the next injection.

Examples of fuel injectors having valves like those just described appear in U.S. Pat. Nos. 3,837,324; 5,460,329; 5,479,901; and 5,597,118. Some fuel injectors have a single electric actuator while others have more than one.

Commonly assigned U.S. Pat. No. 6,029,628 is an example of a fuel injector comprising two electric actuators. A supply valve mechanism is controlled by an electric supply valve actuator for selectively controlling flow of control fluid through a supply passage for downstroking an intensifier piston. A drain valve mechanism is controlled by an electric drain valve actuator for selectively controlling flow of control fluid through a drain passage. Each valve actuator is selectively operable independent of the other to selectively operate the respective valve mechanism independent of the other.

Regardless of the number of electric actuators in a fuel injector, calibration of a fuel injector is important for securing optimal engine performance. Mass production methods inherently result in some variation in calibration from fuel injector to fuel injector. While such methods may strive to minimize the range of these variations, these ranges remain significant enough that some classification of fuel injectors according to a number of different calibration categories, or groups, is believed appropriate in a mass production environment.

Hence, before it is assembled to an engine, a fuel injector is operated to ascertain its actual calibration. The actual calibration determines into which particular one of a number of different calibration categories the fuel injector falls. The fuel injector is then identified by that particular category. When an engine is being manufactured, an associated engine controller is programmed in such a way that the particular calibration category of the fuel injector for each particular engine cylinder is made available to the controller. The controller uses that data to calibrate electric control signals to the fuel injectors.

It is also known to assign a unique part number to each of the various calibration categories and to mark that part number on each fuel injector whose actual calibration falls within that calibration category. When a particular fuel injector in an engine needs to be replaced, the replacement should be one that falls within the same calibration category or else updated information should be furnished to the engine controller if a differently calibrated fuel injector is used as a replacement. A service facility may therefore have to inventory a number of different parts corresponding to the number of different calibration categories, or a controller may have to be re-programmed if a replacement fuel injector belongs to a different calibration category.

U.S. Pat. No. 5,575,264 discloses a method for associating actual performance data with a fuel injector. The data is contained in a medium that is mounted on the fuel injector body and that is suitable for reading by an associated engine controller. An EEPROM is disclosed as an example of a suitable medium.

U.S. Pat. No. 5,839,420 relates to a method for compensating a fuel injection system for fuel injector variability. Each fuel injector includes a storage medium that contains a calibration code identifying the actual calibration of the fuel injector. An associated engine controller converts a raw energizing time to a calibrated energizing time for each fuel injector based the calibration code for the fuel injector.

U.S. Pat. No. 5,634,448 relates to another method for trimming fuel injectors to compensate for fuel injector variability.

SUMMARY OF THE INVENTION

The present invention relates to improvements in identification of fuel injector calibration groups. It is believed that the invention provides certain advantages over the group identification devices and methods mentioned above. The invention may be practiced with fuel injectors having either single or multiple electric actuators. Identification of the calibration group of a fuel injector can be ascertained by an associated engine controller via all or some of the electric conductors that connect a fuel injector to an associated driver circuit. This means that no separate or additional circuit connections to a fuel injector are needed. The controller by itself can read the calibration group identification, thereby avoiding entry of that data into the controller by other means or methods.

The actual identifier for a fuel injector may comprise a passive circuit containing a conventional passive circuit element or elements, namely resistors, capacitors, or inductors, or a network containing one or more such circuit elements, or it may comprise a semi-conductor memory device such as an EEPROM. Such passive circuit elements may in certain instances be preferred because they may be less costly than semi-conductor identifiers and may not require the environmental protection that a semi-conductor device might require in order to provide acceptable service life.

Accordingly, a generic aspect of the present invention relates to a fuel injector comprising a body containing a mechanism that is operable to cause fuel to be injected out of the body and into a combustion chamber of an internal combustion engine and an electric actuator for operating the mechanism to initiate a fuel injection from the body when an initiating electric signal for initiating a fuel injection is applied to the electric actuator and to terminate the fuel injection when the electric signal changes to a terminating electric signal for terminating the fuel injection. The fuel injector also has an identity circuit that possesses a characteristic identifying a calibration category into which the fuel injector has been previously categorized and that responds to an interrogating signal in a manner disclosing the calibration category into which the fuel injector has been categorized. The identity circuit is electrically connected in shunt with the electric actuator and imposes no significant effect on the response of the fuel injector to the initiating and terminating electric signals, and the electric actuator imposes no significant effect on the response of the identity circuit to the interrogating signal.

Still another generic aspect of the present invention relates to an internal combustion engine comprising one or more electric-actuated fuel injectors each of which injects fuel into a respective combustion chamber of the engine. Each fuel injector comprises a body containing a mechanism that is operable to inject fuel out of the body and into the respective combustion chamber and an electric actuator for operating the mechanism. An electric connector on the exterior of the body contains electric terminals for connecting terminals of the actuator to an external circuit for operating the fuel injector. Each fuel injector body has a mounting on the engine that grounds the fuel injector to engine ground. Each fuel injector further comprises an identity circuit that comprises electric terminals, that possesses a characteristic identifying a calibration category into which the fuel injector has been previously categorized, and that responds to an interrogating signal applied across its terminals in a manner disclosing the calibration category into which the fuel injector has been categorized. One terminal of the identity circuit, one terminal of the electric connector, and one terminal of the actuator are connected electrically in common, and another terminal of the identity circuit is connected to engine ground through the mounting of the fuel injector on the engine.

Still another generic aspect of the present invention relates to a fuel injector comprising a body containing a mechanism that is operable to cause fuel to be injected out of the body and into a combustion chamber of an internal combustion engine and an electric actuator for operating the mechanism to initiate a fuel injection from the body when an initiating electric signal for initiating a fuel injection is applied to the electric actuator and to terminate the fuel injection when the electric signal changes to a terminating electric signal for terminating the fuel injection. The electric actuator comprises two solenoid coils that are independently actuated. The injector has an identity circuit that comprises electric terminals, that possesses a characteristic identifying a calibration category into which the fuel injector has been previously categorized, and that responds to an interrogating signal applied across its terminals in a manner disclosing the calibration category into which the fuel injector has been categorized. One terminal of the identity circuit is connected electrically to one of the coils and another terminal of the identity circuit is connected electrically to the other of the coils.

Still another generic aspect of the present invention relates to a method of identifying a calibration category of a fuel injector for injecting fuel into a combustion chamber of an internal combustion engine wherein the fuel injector has electric terminals via which injection-initiating and injection-terminating signals are applied to an electric actuator for operating the fuel injector to initiate and terminate a fuel injection. The method comprises connecting in shunt with the electric actuator an identity circuit that possesses a characteristic identifying a calibration category into which the fuel injector has been previously categorized and that responds to an interrogating signal in a manner disclosing the calibration category into which the fuel injector has been categorized. The identity circuit imposes no significant effect on the response of the fuel injector to the initiating and terminating electric signals, and the electric actuator imposes no significant effect on the response of the identity circuit to the interrogating signal. The method further comprises connecting the electric terminals to an identifying circuit that is external to the fuel injector and causing the identifying circuit to apply an interrogating signal to the identity circuit via the electric terminals. The calibration category of the fuel injector is identified from the electrical response of the identity circuit to the interrogating signal.

Still another generic aspect of the present invention relates to a method of identifying a calibration category of a fuel injector that injects fuel into a combustion chamber of an internal combustion engine wherein the fuel injector has external electric terminals via which injection-initiating and injection-terminating signals are applied to an electric actuator for operating the fuel injector to initiate and terminate a fuel injection, and an identity circuit that comprises electric terminals, that possesses a characteristic identifying a calibration category into which the fuel injector has been previously categorized, and that responds to an interrogating signal applied across its terminals in a manner disclosing the calibration category into which the fuel injector has been categorized. The method comprises mounting the fuel injector body on an engine to establish, via the mounting, a ground between a terminal of the identity circuit and engine ground, and connecting the external electric terminals to a controller that is external to the fuel injector and that also contains an identifying circuit having first and second terminals, one of which is connected in common with engine ground. The identifying circuit applies an interrogating signal to the identity circuit via one of the external electric terminals and engine ground and identifies the calibration category of the fuel injector from the electrical response of the identity circuit to the interrogating signal.

The foregoing, along with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

Figure 1:
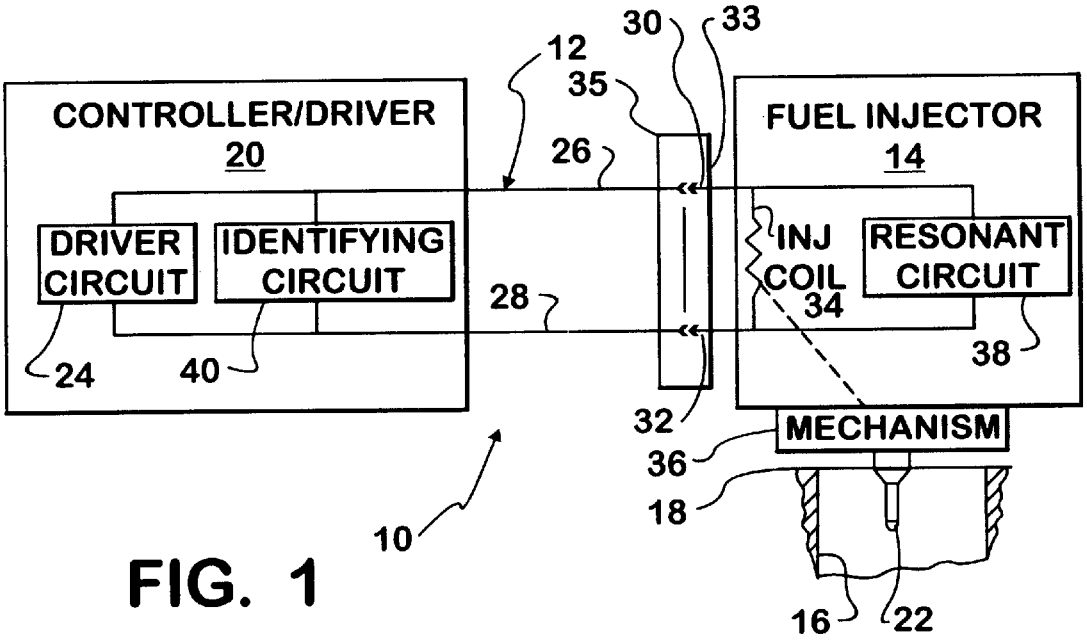
FIG. 1 is a general schematic diagram of a first exemplary embodiment of the present invention.

FIG. 1 shows a portion of a fuel injection system 10 embodying principles of the present invention. An electric circuit 12 is associated with a fuel injector 14 that is associated with a respective cylinder 16 of a representative multi-cylinder, compression-ignition internal combustion engine 18 that powers an automotive vehicle. Although FIG. 1 shows an arrangement for only one cylinder, there is a respective fuel injector 14 for each cylinder. Each fuel injector 14 comprises a body that is mounted on the engine and has a nozzle 22 through which fuel is injected into the corresponding engine cylinder.

System 10 includes a controller/driver 20 having a processor-based controller that operates each fuel injector 14 via a respective driver circuit 24. The processor processes various items of data to develop data representing desired quantities of fuel to be injected by the individual fuel injectors. The data is converted to corresponding electric signals suitable for operating the fuel injectors. Driver circuit 24 supplies the electric signals for operating fuel injector 14. Respective output terminals of driver circuit 24 are connected by wires 26, 28 to respective terminals 30, 32 of an electric actuator 34 of fuel injector 14. Terminals 30, 32 are contained in an electric connector 33 that is external to the engine for connection with a mating connector 35 from driver circuit 24 to connect wires 26, 28 to the two actuator terminals.

Actuator 34 comprises a single solenoid coil that operates an injection mechanism 36 of fuel injector 14. A fuel injection from injector 14 is initiated by an initiating electric signal applied to actuator 34 by driver circuit 24. The fuel injection terminates when the electric signal changes to a terminating electric signal. A pulse width modulated signal may be used to operate the fuel injector, using the rising edge of a pulse as an injection-initiating signal and the falling edge as an injection-terminating signal. The timing of the initiating and terminating electric signals determines the quantity of fuel injected, and takes into account the particular calibration category for the particular fuel injector, as explained earlier. What distinguishes system 10 is the means and method for ascertaining the identity of the calibration category for the particular fuel injector.

According to principles of the invention, fuel injector 14 comprises an identity circuit that possesses an identity characteristic identifying a calibration category into which the fuel injector has been previously categorized. Categorization may be based on data obtained from actual operation of the fuel injector before assembly into engine 18. The particular identity circuit in the example of FIG. 1 comprises a resonant circuit 38.

Resonant circuit 38 is electrically connected in shunt with electric actuator 34 and has an electrical characteristic that imposes no significant effect on the response of the fuel injector to the initiating and terminating electric signals for controlling fuel injection, but that responds to an interrogating signal from an identifying circuit 40 of controller/driver 20 to disclose the calibration category of the fuel injector. An example of a circuit suitable for resonant circuit 38 is a passive RCL circuit that is tuned to a frequency at which actuator 34 presents a very large impedance.

Principles of the present invention also include a method of identifying the calibration category of fuel injector 14 and those of the other fuel injectors. Identifying circuit 40 is operated to cause an interrogating signal to be applied across electric terminals 30, 32. Although the Figure shows a devoted identifying circuit, the interrogating signal could be delivered by driver circuit 24. The identity of circuit 38, meaning the calibration category of the fuel injector, is disclosed by processing the electrical response of circuit 38 to the interrogating signal applied to it. For an identity circuit that comprises an RCL resonant circuit, such as resonant circuit 38, the resonant frequency may be used to designate the calibration category, with a unique resonant frequency being assigned to each category. Hence, identifying circuit 40 may deliver a pulse signal as the interrogating signal, and the frequency of the resulting analog signal oscillation may be processed by controller/driver 20 to yield the identify of the calibration category for the fuel injector.

Figure 2:
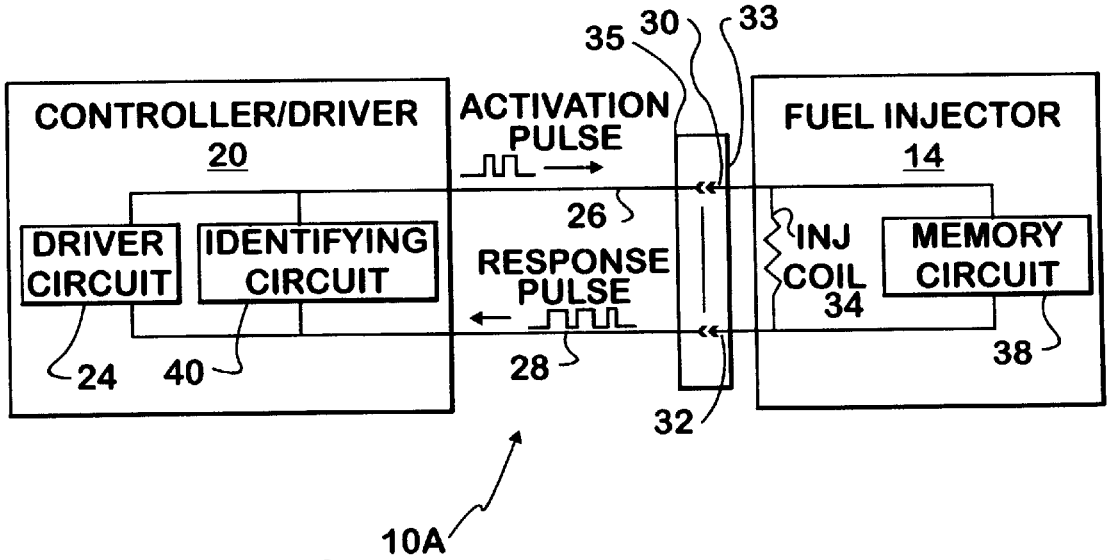
FIG. 2 is a general schematic diagram of a second exemplary embodiment of the present invention.

FIG. 2 discloses a second embodiment of control system 10A which is like control system 10 except for the particular identity circuit and the manner in which the calibration category of the fuel injector is identified. The same reference numerals are used to identify like circuits and circuit components in both Figures, and control system 10A will be described only to the extent of how it differs from control system 10. The identity circuit comprises a memory circuit 38, which may be a semiconductor device such as an EEPROM. Memory circuit 38 is connected in shunt with the solenoid coil forming actuator 34 and imposes no significant effect on the response of the fuel injector to initiating and terminating electric signals that control fuel injection. Memory circuit 38 is programmable to allow the particular calibration category to be entered once the fuel injector has been tested, and the circuit retains the identifying data once it has been entered.

For ascertaining the calibration category of fuel injector 14, identifying circuit 40 issues an interrogating signal, such as an activation pulse signal. Memory circuit 38 has an input/output that receives the activation pulse signal and that responds by returning a response pulse signal disclosing the particular calibration group identity. Controller/driver 20 reads the response pulse signal to determine the calibration category of the fuel injector. Both activation and response pulses have sufficiently high frequency content that coil 34 presents high impedance to them and thereby has no significant effect on the identity reading process.

Figure 3:
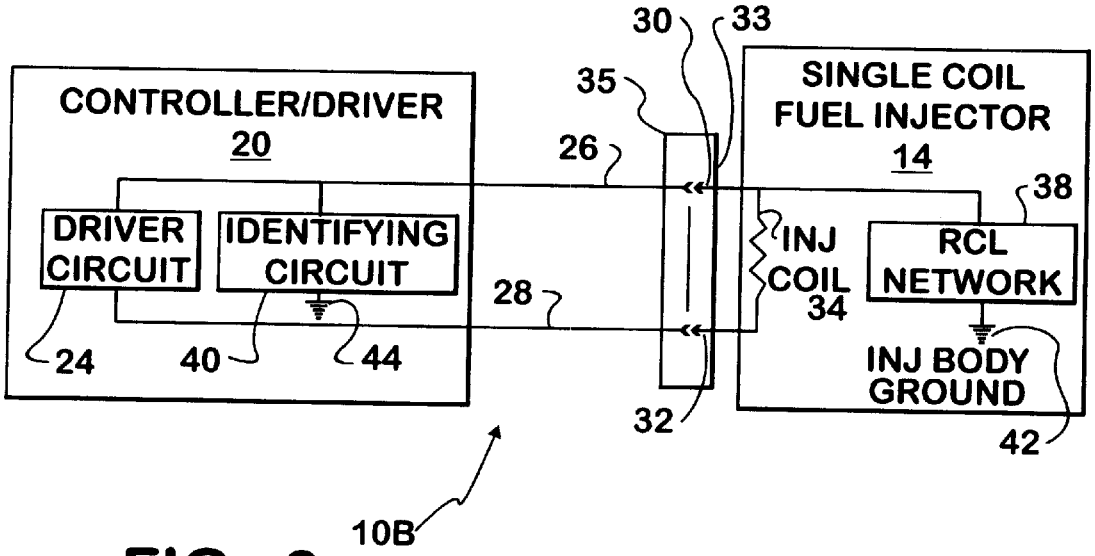
FIG. 3 is a general schematic diagram of a third exemplary embodiment of the present invention.

FIG. 3 discloses a control system 10B in which a single coil fuel injector 14 is connected with controller/driver 20 in the same manner as in FIG. 1. However the manner of associating the identity circuit 38 with actuator 34 is different. Circuit 38, shown by way of example as a resonant circuit, has one terminal connected to one terminal of actuator coil 34, terminal 30 in the example, but the other terminal of circuit 38 is connected to a portion of the fuel injector body that becomes grounded to engine ground 42 when the fuel injector is mounted on the engine.

Controller/driver 20 contains an identifying circuit 40 having one of its terminals connected to injector terminal 30 while its other terminal is connected to a ground 44 that is common with engine ground 42. If controller/driver 20 is mounted on the engine, ground 44 is also engine ground 42. If controller/driver 20 is mounted on a portion of the vehicle other than the engine, such as the body or chassis, it may be connected to the body or chassis ground, with continuity to engine ground 42 being established by a ground strap that is present between the engine and the body or chassis.

Because there is no complete circuit connection between actuator 34 and circuit 38, neither has any significant interaction the other. Hence, actuator 34 has no influence on reading the calibration category, and the identity circuit has no influence on fuel injections. The calibration group of the fuel injector is ascertained in the same manner described earlier in connection with FIG. 1. Although the example shows a resonant circuit 38, it should be appreciated that a different identity circuit, such as a memory circuit, can be used, in which case the calibration group of the fuel injector would be read in the same manner described above in connection with FIG. 2.

Figure 4:
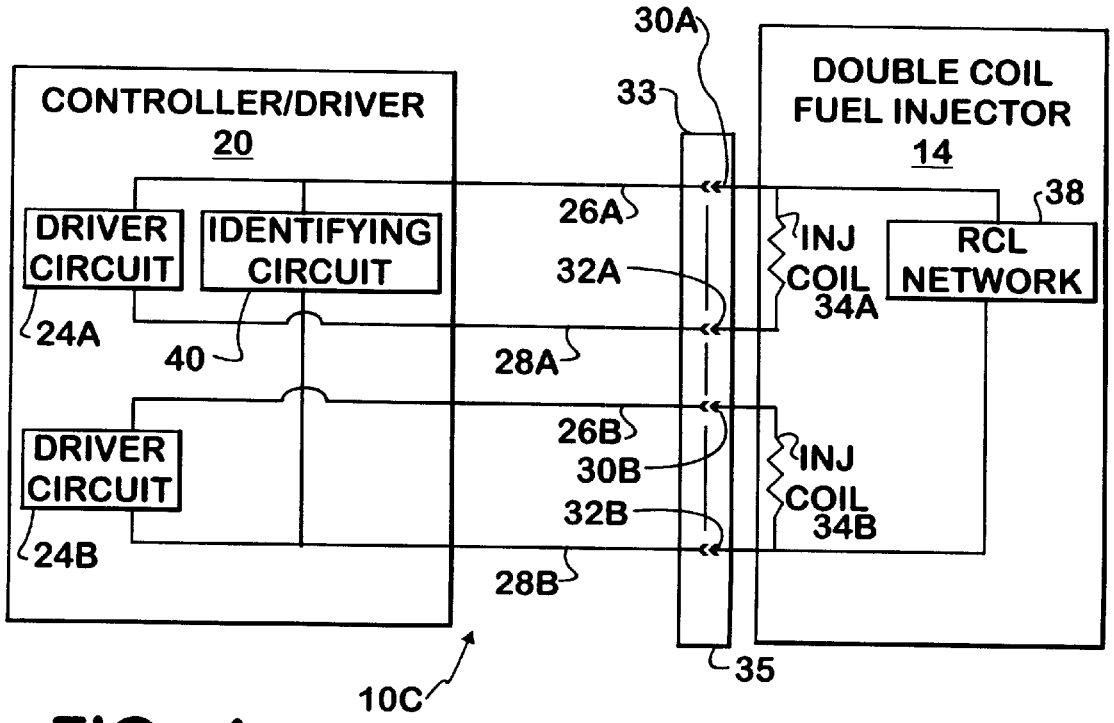
FIG. 4 is a general schematic diagram of a fourth exemplary embodiment of the present invention.

FIG. 4 discloses an embodiment 10C that differs from previous embodiments in that actuator 34 comprises two solenoid coils 34A, 34B and each coil is independently controlled. This fuel injector represents an embodiment like that in U.S. Pat. No. 6,029,628, referred to above. Coil 34A comprises terminals 30A, 32A, and coil 34B comprises terminals 30B, 32B. Coil 34A is connected by respective wires 26A, 28A to its own driver circuit 24A, and coil 34B is connected by respective wires 26B, 28B to its own driver circuit 24B. Terminals 30A, 32A, 30B, 32B are contained in a single connector 35 mating with a four-terminal connector 33.

The identity circuit is connected between one of the terminals of one coil and one of the terminals of the other coil. The example of FIG. 4 shows the identity circuit to comprise an RCL resonant circuit 38. Identifying circuit 40 is connected with circuit 38 via one of the two wires for one coil and one of the two wires for the other coil. Wires 26A, 28B are the two wires used. Thus, identifying circuit 40 has a complete circuit connection only with resonant circuit 38 and not with either coil 34A, 34B. Neither coil has an influence on circuit 38, and likewise circuit 38 has no influence on the operation of either coil. The calibration group of the fuel injector is ascertained in the same manner described earlier in connection with FIG. 1. Although the example of FIG. 4 shows the identity circuit to be a resonant circuit, it should be appreciated that a different identity circuit, such as a memory circuit, can be used, in which case the calibration group of the fuel injector would be read in the same manner described earlier in connection with FIG. 2.

Figure 5:
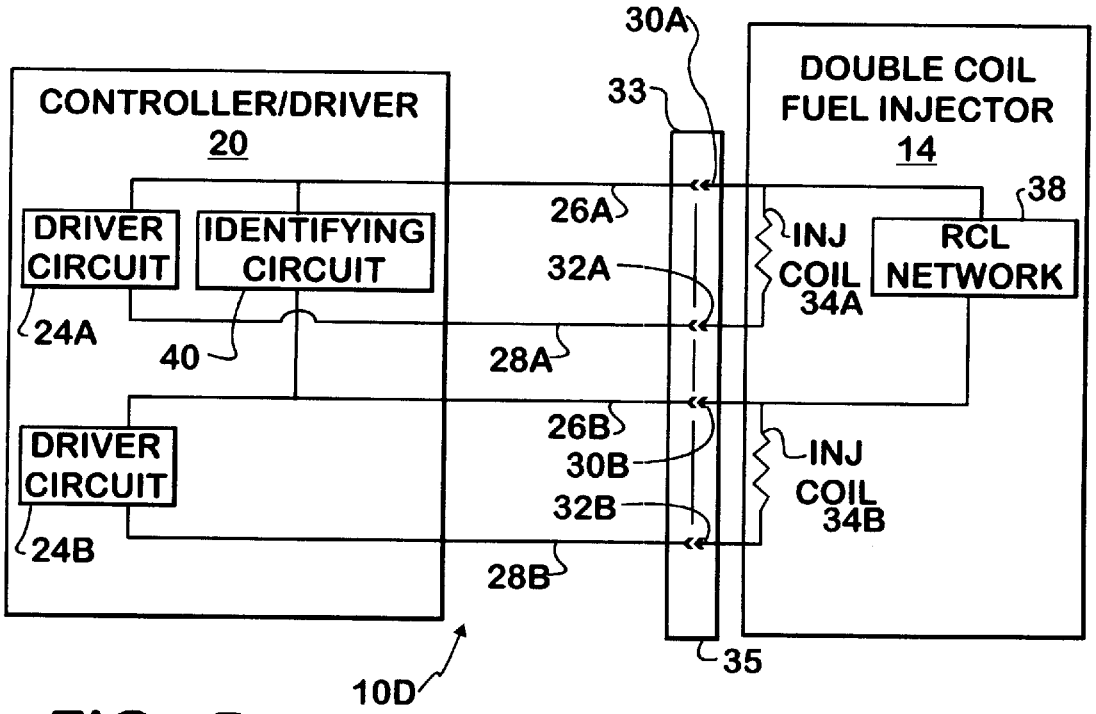
FIG. 5 is a general schematic diagram of a fifth exemplary embodiment of the present invention.

Control system 10D of FIG. 5 is the same as control system 10C of FIG. 4 except that circuit 38 is connected between terminal 30A of coil 34A and terminal 30B of coil 34B. Circuit 40 is therefore connected between terminals 30A and 30B. This configuration would allow terminals 32A, 32B to be electrically common and replaced by a single terminal, and wires 28A, 28B to be replaced by a single wire from controller/driver 20 to that single terminal. As was true for control system 10C, circuit 38 may be any suitable circuit such as a resonant circuit or another circuit, such as a memory circuit.

While a presently preferred embodiment of the invention has been illustrated and described, it should be appreciated that principles of the invention apply to all embodiments falling within the scope of the following claims.

What is claimed is:

1. A fuel injector for injecting fuel into a combustion chamber of an internal combustion engine comprising:

a body containing a mechanism that is operable to cause fuel to be injected out of the body and into the combustion chamber;

an electric actuator for operating the mechanism to initiate a fuel injection from the body when an initiating electric signal for initiating a fuel injection is applied to the electric actuator and to terminate the fuel injection when the electric signal changes to a terminating electric signal for terminating the fuel injection, and an identity circuit that possesses a characteristic identifying a calibration category into which the fuel injector has been previously categorized and that responds to an interrogating signal in a manner disclosing the calibration category into which the fuel injector has been categorized;

wherein the identity circuit is electrically connected in its entirety in shunt with the electric actuator so as to thereby impose no significant effect on the response of the fuel injector to the initiating and terminating electric signals, and the electric actuator imposes no significant effect on the response of the identity circuit to the interrogating signal.

2. A fuel injector as set forth in claim 1 in which the identity circuit comprises a memory circuit.

3. A fuel injector as set forth in claim 2 in which the memory circuit contains programmed data representing the calibration category of the fuel injector.

4. A fuel injector as set forth in claim 1 in which the electric actuator comprises a single solenoid coil with which the identity circuit is electrically connected in shunt.

5. A fuel injector for injecting fuel into a combustion chamber of an internal Combustion engine comprising:

a body containing a mechanism that is operable to cause fuel to be injected out of the body and into the combustion chamber;

an electric actuator for operating the mechanism to initiate a fuel injection from the body when an initiating electric signal for initiating a fuel injection is applied to the electric actuator and to terminate the fuel injection when the electric signal changes to a terminating electric signal for terminating the fuel injection, and an identity circuit that possesses a characteristic identifying a calibration category into which the fuel injector has been previously categorized and that responds to an interrogating signal in a manner disclosing the calibration category into which the fuel injector has been categorized;

wherein the identity circuit is electrically connected in shunt with the electric actuator: and imposes no significant effect on the response of the fuel injector to the initiating and terminating electric signals, and the electric actuator imposes no significant effect on the response of the identity circuit to the interrogating signal; and in which the identity circuit comprises a resonant circuit.

6. A fuel injector for injecting fuel into a combustion chamber of an internal combustion engine comprising:

a body containing a mechanism that is operable to cause fuel to be injected out of the body and into the combustion chamber;

an electric actuator for operating the mechanism to initiate a fuel injection from the body when an initiating electric signal for initiating a fuel injection is applied to the electric actuator and to terminate the fuel injection when the electric signal changes to a terminating electric signal for terminating the fuel injection, and an identity circuit that possesses a characteristic identifying a calibration category into which the fuel injector has been previously categorized and that responds to an interrogating signal in a manner disclosing the calibration category into which the fuel injector has been categorized;

wherein the identity circuit is electrically connected in shunt with the electric actuator: and imposes no significant effect on the response of the fuel injector to the initiating and terminating electric signals, and; the electric actuator imposes no significant effect on the response of the identity circuit to the interrogating signal; and in which the electric actuator comprises two solenoid coils that can be independently actuated, and the identity circuit is electrically connected in shunt with one of the solenoid coils and not with the other.

7. A method of identifying a calibration category of a fuel injector for injecting fuel into a combustion chamber of an internal combustion engine wherein the fuel injector has electric terminals via which injection-initiating and injection-terminating signals are applied to an electric actuator for operating the fuel injector to initiate and terminate a fuel injection, the method comprising;

connecting in shunt with the electric actuator an identity circuit that possesses a characteristic identifying a calibration category into which the fuel injector has been previously categorized and that responds to an interrogating signal in a manner disclosing the calibration category into which the fuel injector has been categorized, wherein the identity circuit is connected in its entirety in shunt with the electric actuator so as to thereby impose no significant effect on the response of the fuel injector to the initiating and terminating electric signals, and the electric actuator imposes no significant effect on the response of the identity circuit to the interrogating signal;

connecting the electric terminals to an identifying circuit that is external to the fuel injector;

causing the identifying circuit to apply an interrogating signal to the identity circuit via the electric terminals;

identifying the calibration category of the fuel injector from the electrical response of the identity circuit to the interrogating signal.

8. A method as set forth in claim 7 in which the step of identifying the calibration category of the fuel injector from the electrical response of the identity circuit to the interrogating signal comprises processing pulse signal data constituting the electrical response of the identity circuit to the interrogating signal.

9. A method as set forth in claim 7 in which the step of identifying the calibration category of the fuel injector from the electrical response of the identity circuit to the interrogating signal comprises processing analog signal data constituting the electrical response of the identity circuit to the interrogating signal.

10. A method as set forth in claim 7 in which the electric actuator comprises a single solenoid coil to which the electric terminals are connected, and the step of connecting the identity circuit in shunt with the electric actuator comprises connecting the identity circuit in shunt with the single solenoid coil.

11. A method of identifying a calibration category of a fuel injector for injecting fuel into a combustion chamber of an internal combustion engine wherein the fuel injector has electric terminals via which injection-initiating and injection-terminating signals are applied to an electric actuator for operating the fuel injector to initiate and terminate a fuel injection, the method comprising:

connecting in shunt with the electric actuator an identity circuit that possesses a characteristic identifying a calibration category into which the fuel injector has been previously categorized and that responds to an interrogating signal in a manner disclosing the calibration category into which the fuel injector has been categorized, wherein the identity circuit imposes no significant effect on the response of the fuel injector to the initiating and terminating electric signals, and the electric actuator imposes no significant effect on the response of the identity circuit to the interrogating signal;

connecting the electric terminals to an identifying circuit that is external to the fuel injector;

causing the identifying circuit to apply an interrogating signal to the identity circuit via the electric terminals;

identifying the calibration category of the fuel injector from the electrical response of the identity circuit to the interrogating signal; and in which the electric actuator comprises two solenoid coils to one of which some of the electric terminals are connected and to the other of which other of the electric terminals are connected to provide for independently actuation of the solenoid coils, and the step of connecting the identity circuit in shunt with the electric actuator comprises connecting the identity circuit in shunt with one of the solenoid Coils and not with the other.

12. An internal combustion engine comprising:

one or more electric-actuated fuel injectors each of which injects fuel into a respective combustion chamber of the engine;

each fuel injector comprising a body containing a mechanism that is operable to inject fuel out of the body and into the respective combustion chamber, an electric actuator for operating the mechanism, and an electric connector on the exterior of the body containing electric terminals for connecting terminals of the actuator to an external circuit for operating the fuel injector;

each fuel injector body having a mounting on the engine that grounds the fuel injector to engine ground;

each fuel injector further comprising an identity circuit that comprises electric terminals, that possesses a characteristic identifying a calibration category into which the fuel injector has been previously categorized, and that responds to an interrogating signal applied across its terminals in a manner disclosing the calibration category into which the fuel injector has been categorized;

wherein one terminal of the identity circuit, one terminal of the electric connector, and one terminal of the actuator are connected electrically in common, and another terminal of the identity circuit is connected to engine ground through the mounting of the fuel injector on the engine.

13. An engine as set forth in claim 12 in which each identity circuit comprises a resonant circuit.

14. A fuel injector for injecting fuel into a combustion chamber of an internal combustion engine comprising:

a body containing a mechanism that is operable to cause fuel to be injected out of the body and into the combustion chamber;

an electric actuator for operating the mechanism to initiate a fuel injection from the body when an initiating electric signal for initiating a fuel injection is applied to the electric actuator and to terminate the fuel injection when the electric signal changes to a terminating electric signal for terminating the fuel injection, the electric actuator comprising two solenoid coils that are independently actuated; and an identity circuit that comprises electric terminals, that possesses a characteristic identifying a calibration category into which the fuel injector has been previously categorized, and that responds to an interrogating signal applied across its terminals in a manner disclosing the calibration category into which the fuel injector has been categorized;

wherein one terminal of the identity circuit is connected electrically to one of the coils and another terminal of the identity circuit is connected electrically to the other of the coils.

15. A fuel injector as set forth in claim 14 in which the identity circuit comprises a resonant circuit.

16. A method of identifying a calibration category of a fuel injector that injects fuel into a combustion chamber of an internal combustion engine wherein the fuel injector has external electric terminals via which injection-initiating and injection-terminating signals are applied to an electric actuator for operating the fuel injector to initiate and terminate a fuel injection, and an identity circuit that comprises electric terminals, that possesses a characteristic identifying a calibration category into which the fuel injector has been previously categorized, and that responds to an interrogating signal applied across its terminals in a manner disclosing the calibration category into which the fuel injector has been categorized, the method comprising:

mounting the fuel injector body on an engine to establish, via the mounting, a ground between a terminal of the identity circuit and engine ground;

connecting the external electric terminals to a controller that is external to the fuel injector and that also contains an identifying circuit having first and second terminals, one of which is connected in common with engine ground;

causing the identifying circuit to apply an interrogating signal to the identity circuit via one of the external electric terminals and engine ground;

identifying the calibration category of the fuel injector from the electrical response of the identity circuit to the interrogating signal.

17. A fuel injector for injecting fuel into a combustion chamber of an internal combustion engine comprising:

a body containing a mechanism that is operable to cause fuel to be injected out of the body and into the combustion chamber;

an electric actuator for operating the mechanism to initiate and terminate fuel injection, the electric actuator comprising two electric devices that are independently actuated, one device being actuated by an initiating electric signal to initiate fuel injection and the other device being actuated by a terminating electric signal to terminate fuel injection;

electric terminals via which the electric signals are delivered to the electric devices; and an identity circuit that possesses a characteristic identifying a calibration category into which the fuel injector has been previously categorized and that responds to an interrogating signal in a manner disclosing the calibration category into which the fuel injector has been categorized;

wherein the identity circuit is connected electrically between a first of the electric terminals that has a direct electrical connection to the one electric device and a second of the electric terminals that has a direct electrical connection to the other electric device.

18. A fuel injector as set forth in claim 17 in which the electric devices comprise respective solenoid coils.

19. A fuel injector as set forth in claim 18 in which one solenoid coil is connected directly between the first electric terminal and a third of the electric terminals, the other solenoid coil is connected directly between the second electric terminal and a fourth of the electric terminals.

20. A method of identifying a calibration category of a fuel injector for injecting fuel into a combustion chamber of an internal combustion engine and then operating the fuel injector wherein the fuel injector has an electric actuator comprising two electric devices that are independently actuated, one device being actuated by an initiating electric signal to initiate fuel injection and the other device being actuated by a terminating electric signal to terminate fuel injection, electric terminals via which the electric signals are delivered to the electric devices, and an identity circuit connected between a first of the electric terminals that has a direct electrical connection to the one electric device and a second of the electric terminals that has a direct electrical connection to the other electric device, the identity circuit possessing a characteristic identifying a calibration category into which the fuel injector has been previously categorized and that responds to an interrogating signal in a manner disclosing the calibration category into which the fuel injector has been categorized; the method comprising:

connecting the electric terminals to a controller for identifying the calibration category of the fuel injector and for delivering the electric signals to the devices;

causing the controller to deliver an interrogating signal to the identity circuit via the first and second electric terminals;

identifying the calibration category of the fuel injector from the electrical response of the identity circuit to the interrogating signal; and causing the controller to deliver the initiating electric signal to the one device and the terminating electric signal to the other device in accordance with the calibration category identified by the response to the interrogating signal.

21. A fuel injector for injecting fuel into a combustion chamber of an internal combustion engine comprising;

a body containing a mechanism that is operable to cause fuel to be injected out of the body and into the combustion chamber;

an electric actuator for operating the mechanism to initiate a fuel injection from the body and to terminate the fuel injection in response to an electric signal input to the actuator, and an identity circuit that possesses a characteristic identifying a calibration category into which the fuel injector has been previously categorized and that responds to an interrogating signal input in a manner disclosing the calibration category into which the fuel injector has been categorized;

wherein the identity circuit shunts the electric actuator without placing any circuit element of the identity circuit in series with the actuator so as to thereby impose no significant effect on the response of the fuel injector to the electric signal input, and the electric actuator imposes no significant effect on the response of the identity circuit to the interrogating signal input.

22. A fuel injector as set forth in claim 21 in which the fuel injector has external electric terminals via which the electric signal input is delivered to the electric actuator and via which the interrogating signal input is applied to the identity circuit, and both the actuator and the identity circuit are directly connected to common ones of the external terminals.

23. A fuel injector as set forth in claim 21 in which the fuel injector has external electric terminals via which the electric signal input is delivered to the electric actuator and the interrogating signal input is applied to the identity circuit, and both the actuator and the identity circuit are directly connected to a common one of the external terminals, and the identity circuit, but not the actuator, is directly connected to another of the external terminals.

* * * * *